US007612548B2

(12) United States Patent
Jian

(10) Patent No.: US 7,612,548 B2
(45) Date of Patent: Nov. 3, 2009

(54) LOW DROP-OUT VOLTAGE REGULATOR WITH HIGH-PERFORMANCE LINEAR AND LOAD REGULATION

(75) Inventor: Ming-Hong Jian, Hsinchu (TW)

(73) Assignee: Holtek Semiconductor Inc., Hsinchu (TW)

( * ) Notice: Subject to any disclaimer, the term of this patent is extended or adjusted under 35 U.S.C. 154(b) by 52 days.

(21) Appl. No.: 12/041,809

(22) Filed: Mar. 4, 2008

(65) Prior Publication Data

US 2009/0009147 A1 Jan. 8, 2009

(30) Foreign Application Priority Data

Jul. 3, 2007 (TW) ..... 96124121 A

(51) Int. Cl.
*G05F 1/40* (2006.01)
*G05F 3/16* (2006.01)

(52) U.S. Cl. ..... 323/280; 323/315

(58) Field of Classification Search ..... 323/274, 323/280, 314, 315, 316
See application file for complete search history.

(56) References Cited

U.S. PATENT DOCUMENTS 5,397,940 A * 3/1995 Janssen ..... 326/83
5,559,425 A * 9/1996 Allman ..... 323/315
5,563,501 A * 10/1996 Chan ..... 323/282
5,739,681 A * 4/1998 Allman ..... 323/314

* cited by examiner

*Primary Examiner*—Jessica Han
(74) *Attorney, Agent, or Firm*—WPAT, PC; Justin I. King

(57) ABSTRACT

A low drop-out voltage regulator with high-performance linear and load regulation, comprising: a reference voltage circuit, capable of providing a reference voltage; a differential amplifier; a power device, capable of driving a load resistor; a feedback circuit, disposed between the differential amplifier and the power device so that the differential amplifier outputs a correction voltage after the reference voltage and a feedback voltage across the feedback circuit; and a voltage buffer for frequency compensation, disposed between the differential amplifier and the power device, the voltage buffer comprising a complementary type buffer.

5 Claims, 6 Drawing Sheets

| | N-Type | P-Type | C-Type |
|---|---|---|---|
| Linear Regulation | Poor | Excellent | Acceptable |
| Load Regulation | Excellent | Poor | Acceptable |

LOW DROP-OUT VOLTAGE REGULATOR WITH HIGH-PERFORMANCE LINEAR AND LOAD REGULATION

BACKGROUND OF THE INVENTION

1. Field of the Invention

The present invention generally relates to a low drop-out voltage regulator with high-performance linear and load regulation and, more particularly, to a low drop-out voltage regulator using a complementary type buffer to overcome poor linear and load regulation and poor stability in a conventional voltage regulator using an n-type buffer or a p-type buffer.

2. Description of the Prior Art

Please refer to FIG. 1, which is a circuit diagram of a conventional low drop-out voltage regulator. The low drop-out voltage regulator comprises: a reference voltage (Vref) circuit, an error amplifier, a power device and a feedback circuit. In applications where a low drop-out voltage regulator is used, a regulation capacitor (Cout) is disposed on the output. Therefore, dominant poles of the low drop-out voltage regulator mostly often appear at the output (Vout). When the output load current increases, the dominant poles move toward higher frequencies to cause poorer reliability of the low drop-out voltage regulator since the output resistance of the power device is in inverse proportion to the output load current.

Please refer to FIG. 2, which is a Bode's plot of a low drop-out voltage regulator. The gain and frequency response relation depends on 1/RC. In FIG. 2, the dominant poles are different for heavy load and light load.

Therefore, frequency compensation of a conventional low drop-out voltage regulator is achieved by adding a voltage buffer between the error amplifier and the power device. With a low output resistance, the voltage buffer moves the pole (for example, the second pole) at the output of the error amplifier outside the frequency band-width. In such a manner, the stability of the low drop-out voltage regulator is assured. Such a conventional voltage buffer uses an n-type or a p-type MOSFET. At steady states, a load current is provided at the output of the low drop-out voltage regulator. Since the feedback control over the power device is not activated yet, the output capacitor has to discharge the load resistor (RL) so that the low drop-out voltage regulator provides the load current. Meanwhile, the output voltage is lowered. As the output voltage is lowered, the error amplifier is activated and the output voltage of the error amplifier is lowered. Therefore, the power device outputs a current to the output capacitor to achieve regulation of output voltage.

Please refer to FIG. 3A and FIG. 3B for circuit diagrams of a conventional low drop-out voltage regulator using a p-type buffer and an n-type buffer, respectively, for frequency compensation. If the voltage buffer for frequency compensation uses a p-channel MOSFET and the low drop-out voltage regulator operates with a heavy load current, the current from the power device decreases because the output voltage of the error amplifier is increased by a voltage of $+V_{SG}$ across the p-type buffer. Therefore, the output voltage of the error amplifier has to be lowered to achieve regulation of output voltage. However, this decreases the loop gain of the low drop-out voltage regulator and leads to poorer load regulation.

On the contrary, if the voltage buffer for frequency compensation uses an n-channel MOSFET, the input voltage of the low drop-out voltage regulator and the low drop-out voltage regulator operates without any load current, the current charging the output capacitor cannot be reduced by the power device and the output voltage of the power device decreases due to leakage current of the power device when there is no load because the output voltage of the error amplifier is decreased by a voltage of $-V_{GS}$ across the n-type buffer. Therefore, the output voltage of the error amplifier has to be enhanced to achieve regulation of output voltage. However, this decreases the loop gain of the low drop-out voltage regulator and leads to poorer load regulation.

Therefore, there exists a need in providing a low drop-out voltage regulator with high-performance linear and load regulation a low drop-out voltage regulator with high-performance linear and load regulation using a complementary type buffer for frequency compensation to overcome poor linear and load regulation and poor stability in a conventional voltage regulator using an n-type buffer or a p-type buffer.

SUMMARY OF THE INVENTION

It is one object of the present invention to provide a low drop-out voltage regulator with high-performance linear and load regulation a low drop-out voltage regulator with high-performance linear and load regulation using a complementary type buffer to overcome poor linear and load regulation and poor stability in a conventional voltage regulator using an n-type buffer or a p-type buffer.

In order to achieve the foregoing object, the present invention provides a low drop-out voltage regulator with high-performance linear and load regulation, comprising: a reference voltage circuit, capable of providing a reference voltage; a differential amplifier; a power device, capable of driving a load resistor; a feedback circuit, disposed between the differential amplifier and the power device so that the differential amplifier outputs a correction voltage after the reference voltage and a feedback voltage across the feedback circuit; and a voltage buffer for frequency compensation, disposed between the differential amplifier and the power device, the voltage buffer comprising a complementary type buffer.

BRIEF DESCRIPTION OF THE DRAWINGS

The objects, spirits and advantages of the preferred embodiment of the present invention will be readily understood by the accompanying drawings and detailed descriptions, wherein.

DETAILED DESCRIPTION OF THE PREFERRED EMBODIMENT

The present invention can be exemplified by the preferred embodiment as described hereinafter.

Figure 1:
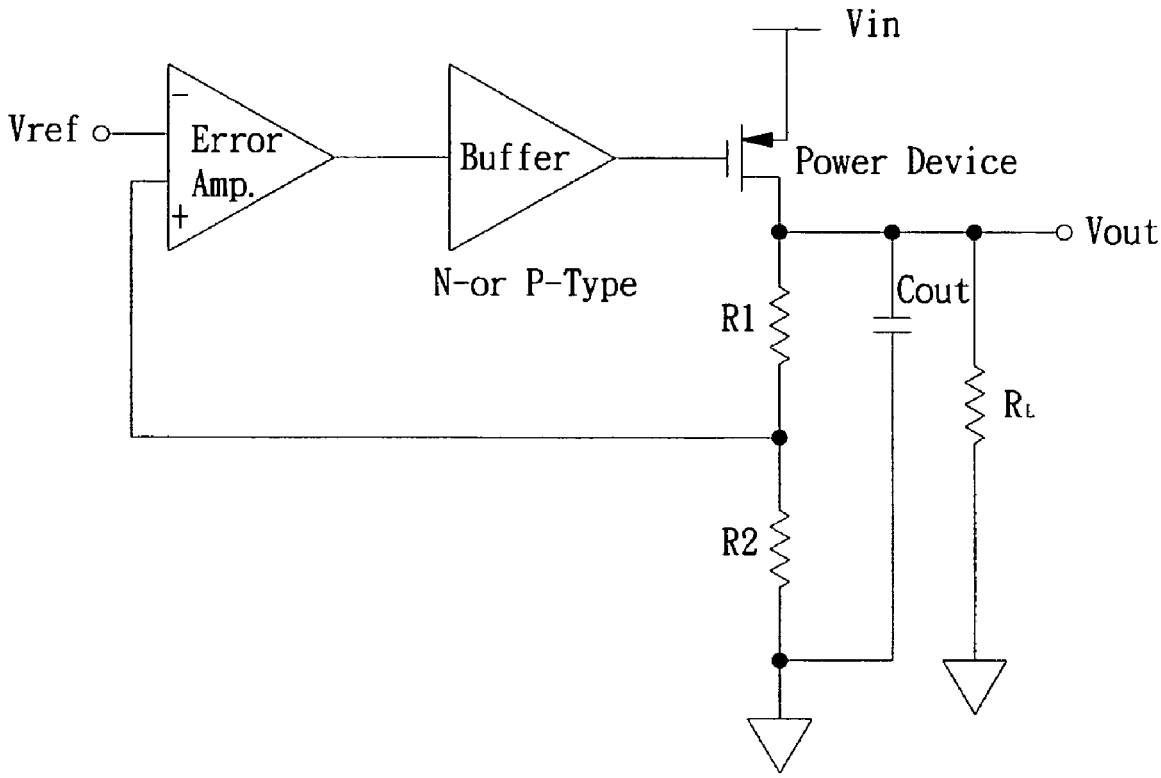
FIG. 1 (Prior Art)
FIG. 1 is a circuit diagram of a conventional low drop-out voltage regulator.
Figure 2:
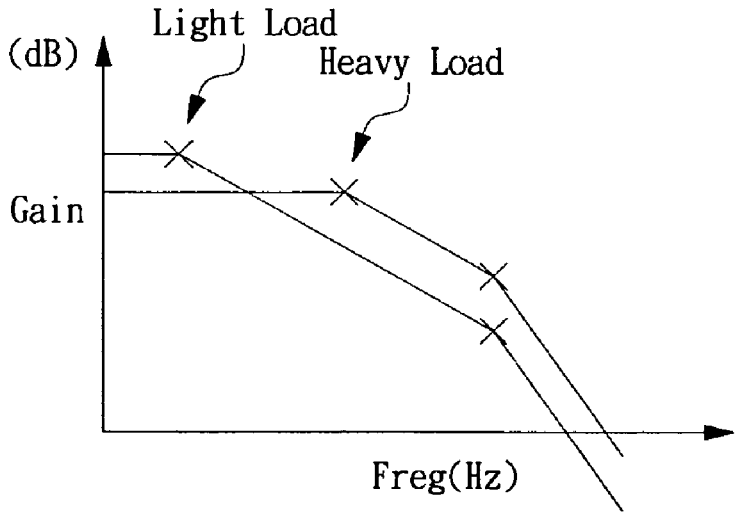
FIG. 2 (Prior Art)
FIG. 2 is a Bode's plot of a low drop-out voltage regulator.
Figure 3A:
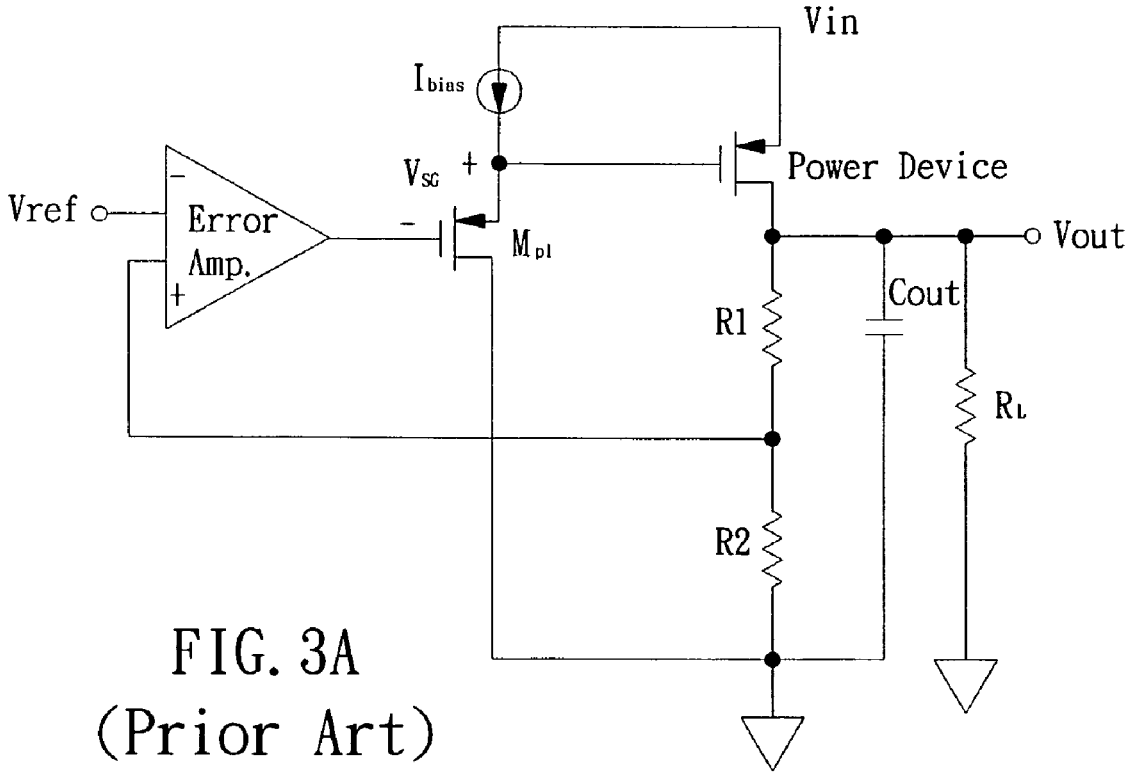
FIG. 3A (Prior Art)
FIG. 3A is a circuit diagram of a conventional low drop-out voltage regulator using a p-type buffer for frequency compensation.
Figure 3B:
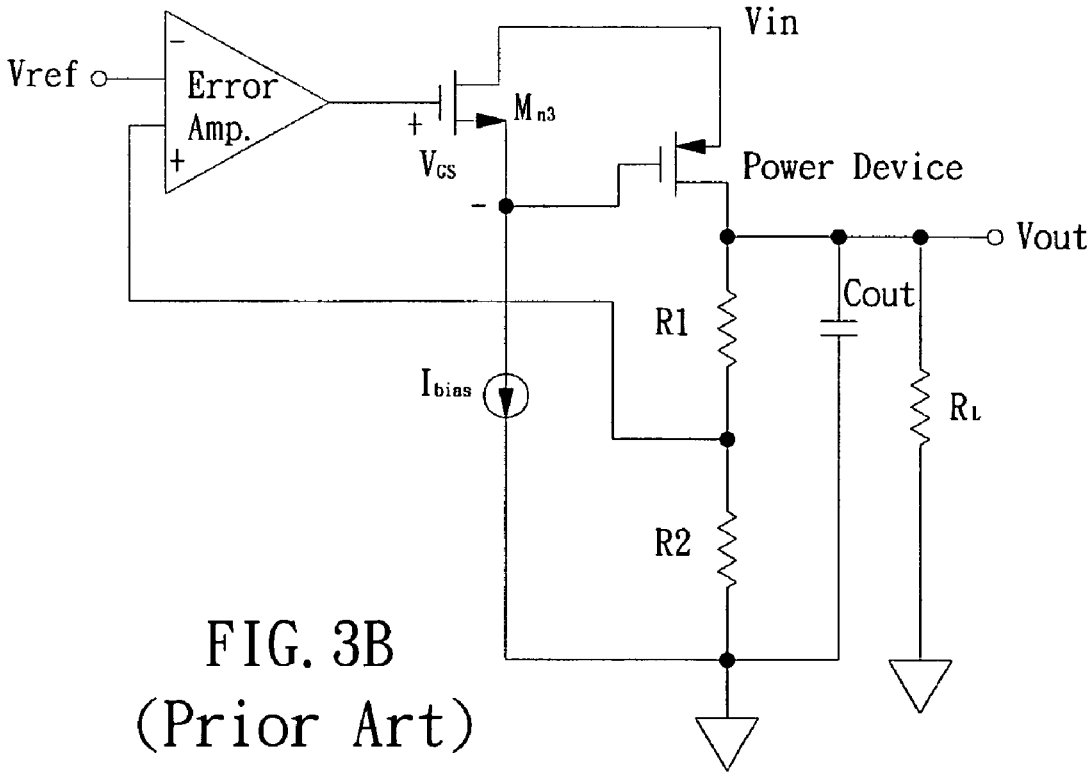
FIG. 3B (Prior Art)
FIG. 3B is a circuit diagram of a conventional low drop-out voltage regulator using an n-type buffer for frequency compensation.
Figures 4A, 4B:
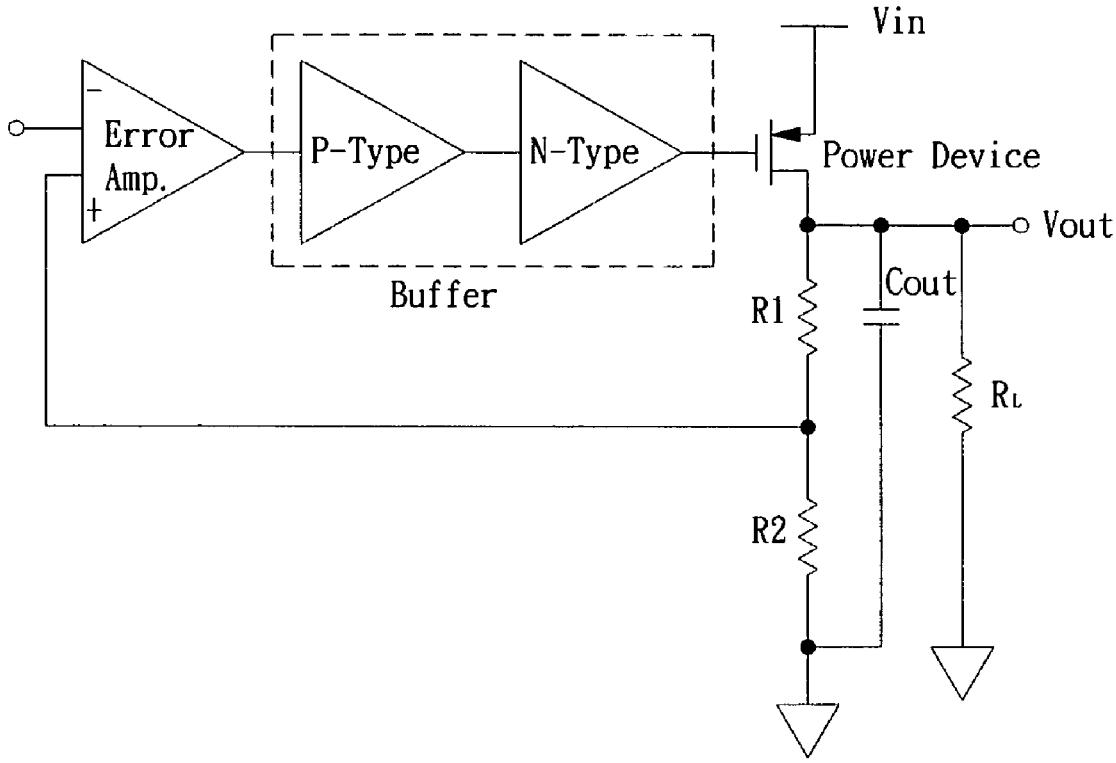
FIG. 4A is a circuit diagram of a low drop-out voltage regulator using a complementary type buffer for frequency compensation according to the present invention.
FIG. 4B is a table showing the comparison of linear and load regulation using three types of buffer.

Please refer to FIG. 4A, which is a circuit diagram of a low drop-out voltage regulator using a complementary type buffer for frequency compensation according to the present invention. In FIG. 4A, the low drop-out voltage regulator comprises a reference voltage (Vref) circuit, an error amplifier, a power device, a voltage buffer and a feedback circuit.

The reference voltage circuit is capable of providing a reference voltage. The power device is capable of driving a load resistor ($R_L$). The feedback circuit is disposed between the error amplifier and the power device so that the differential amplifier outputs a correction voltage after the reference voltage and a feedback voltage across the feedback circuit. The voltage buffer for frequency compensation is disposed between the differential amplifier and the power device. The voltage buffer comprises a complementary type buffer.

The circuit configuration of the present invention is provided with an attempt to overcome the drawbacks of the conventional low drop-out voltage regulator using an n-type or a p-type buffer for frequency compensation to exhibit poor linear and load regulation. In the present invention, a complementary type buffer is used to comprise an n-type buffer to exhibit excellent load regulation and a p-type buffer to exhibit excellent linear regulation. Therefore, the circuit configuration of the present invention is provided to improve linear and load regulation of the low drop-out voltage regulator.

Please refer to FIG. 4B, which is a table showing the comparison of linear and load regulation using three types of buffer. It is observed from the table that:

1. The n-type buffer exhibits poor linear regulation and excellent load regulation.
2. The p-type buffer exhibits excellent linear regulation and poor load regulation.
3. The complementary type buffer in the present invention exhibits acceptable linear regulation and load regulation to overcome the drawbacks of the n-type and the p-type buffers.

Figure 5:
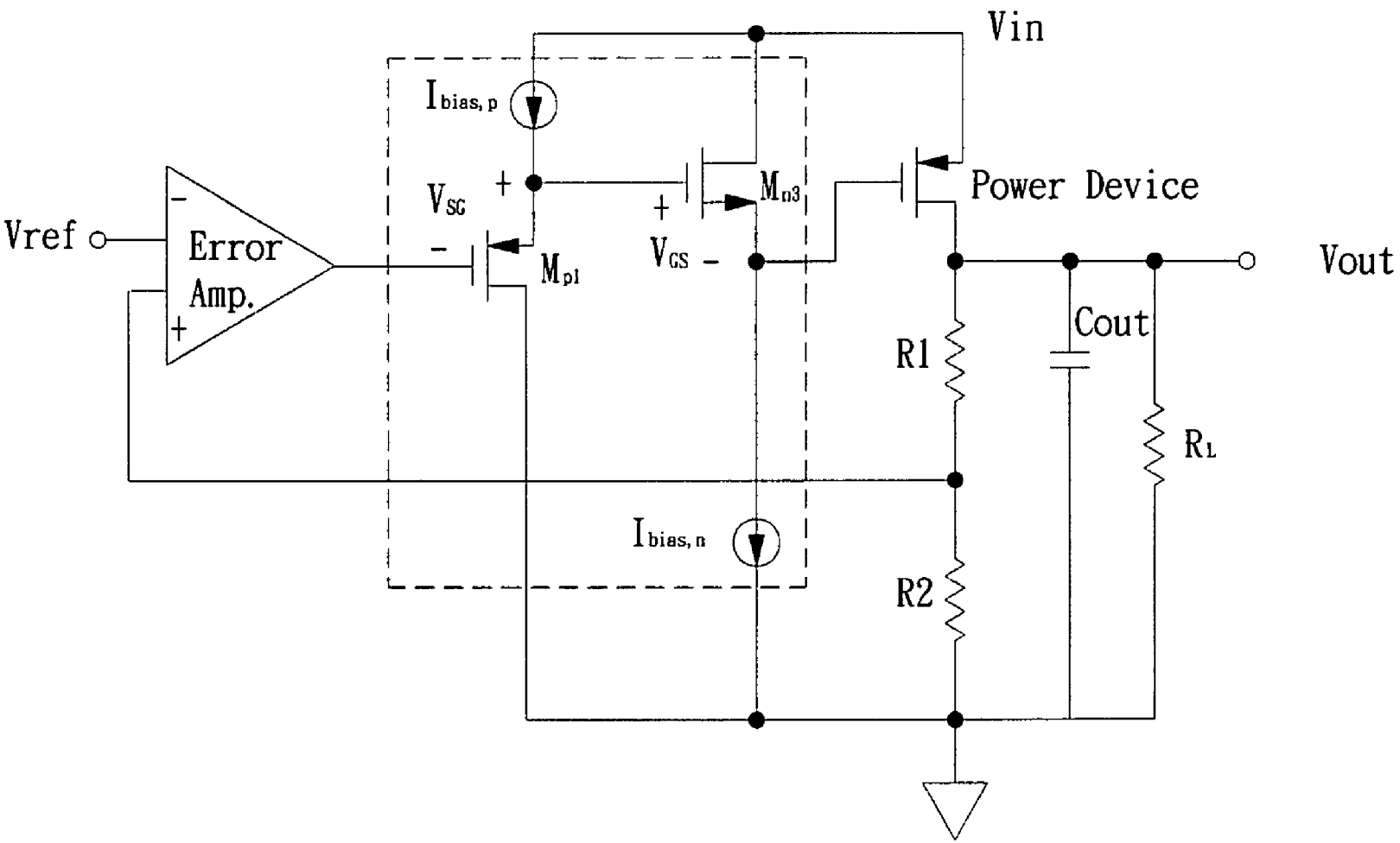
FIG. 5 is a detailed circuit diagram of a low drop-out voltage regulator in FIG. 4A.

Please refer to FIG. 5, which is a detailed circuit diagram of a low drop-out voltage regulator in FIG. 4A. In FIG. 4A, the n-type buffer of the complementary type buffer is decreased the input voltage by a voltage of $-V_{GS}$ and the p-type buffer is increased the input voltage by a voltage of $+V_{SG}$ to achieve frequency compensation of the complementary type buffer and improve linear and load regulation of the low drop-out voltage regulator. Therefore, the dynamic range of the input voltage and the load current of the low drop-out voltage regulator is enhanced.

For example, when there is a small load resistor ($R_L$) disposed at the output of the low drop-out voltage regulator, the output voltage of the error amplifier decreases and the voltage signal first goes through the p-type buffer so that the voltage is increased by a source-to-gate voltage ($+V_{SG}$) and then goes through the n-type buffer so that the voltage is decreased by a negative gate-to-source voltage ($-V_{GS}$). Therefore, the gate voltage of the p-channel MOS power device is almost equal to the original output voltage of the error amplifier. For the gate voltage of the p-channel MOS power device, the difference between the gate voltage of the complementary type buffer and the gate voltage of the p-type buffer is about source-to-gate voltage ($+V_{SG}$). To achieve voltage regulation, the gate voltage of p-channel MOS power device in the p-type buffer has to be lowered. However, this decreases the gain of the error amplifier and leads to poorer load regulation of the low drop-out voltage regulator.

On the contrary, when the input voltage of the low drop-out voltage regulator increases, the output voltage of the error amplifier increases. The voltage signal goes through the p-type buffer and n-type buffer for voltage step-up and step-down, respectively, so that the gate voltage of the p-channel MOS power device is almost equal to the output voltage of the error amplifier. This prevents the power device from charging the output capacitor to avoid leakage in the power device when there is no load to prevent the output voltage of the low drop-out voltage regulator from being too high.

More particularly, the gate voltage of p-channel MOS power device in the n-type buffer has to be higher. However, this decreases the gain of the error amplifier and leads to poorer linear regulation of the low drop-out voltage regulator. The p-type buffer and the n-type buffer use a bias current ($I_{bias,p}$) and ($I_{bias,n}$) as a current source thereof, respectively.

Figure 6:
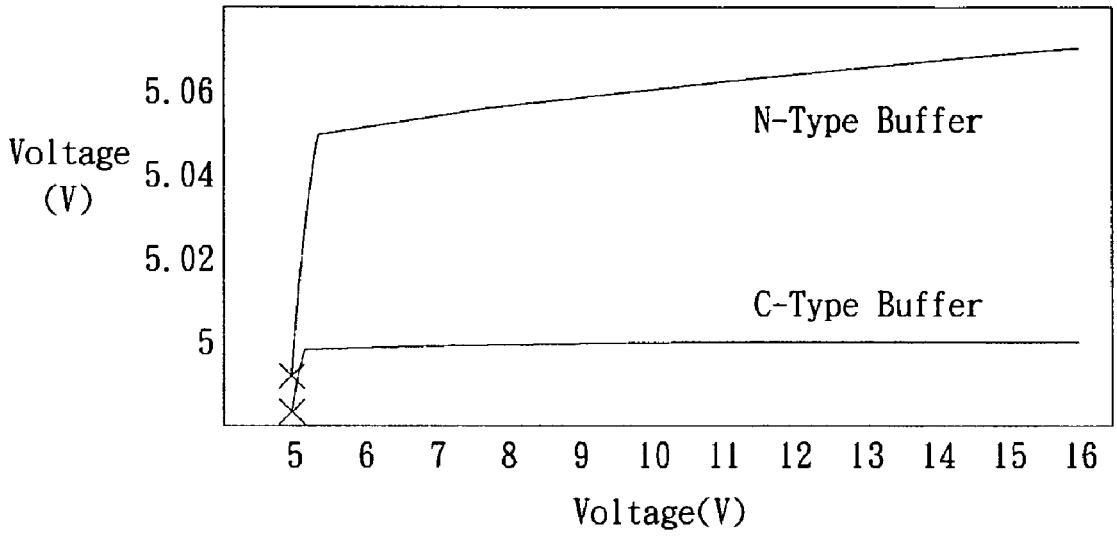
FIG. 6 is a simulation result of linear regulation using n-type and complementary type buffers.
Figure 7:
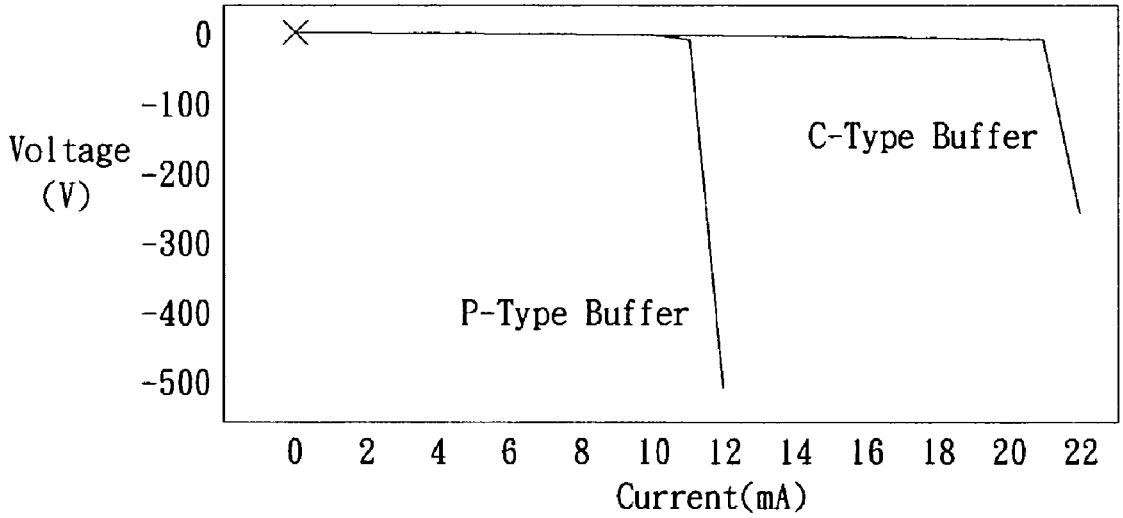
FIG. 7 is a simulation result of load regulation using p-type and complementary type buffers.

Please refer to FIG. 6 and FIG. 7 for the simulation result of linear regulation using the complementary type buffer. In FIG. 6, the input voltage Vin=8~16V, and the load current Iout=0A. In FIG. 7, the input voltage Vin=8V, the load current Iout=0~22 mA. The output voltage Vout=5V in both FIG. 6 and FIG. 7.

FIG. 6 is a simulation result of linear regulation using n-type and complementary type buffers. It is clear that, due to leakage in the p-channel MOS power device, the output voltage increases with the input voltage. With the use of the complementary type buffer, the leakage in the p-channel MOS power device is reduced to improve linear regulation with the same input voltage.

FIG. 7 is a simulation result of load regulation using p-type and complementary type buffers. It is clear that, with the same power device, the driving current of the complementary type buffer is higher than that of the p-type buffer because the complementary type buffer has a larger loop gain than the p-type buffer when operating with a heavy load. Moreover, the area of the p-channel MOS power device can be reduced since the complementary type buffer exhibits larger driving current.

Evidently, from FIG. 6 and FIG. 7, the complementary type buffer of the present invention, compared to the p-type buffer or the n-type buffer, exhibits better linear and load regulation. Therefore, the low drop-out voltage regulator of the present invention out-performs the conventional low drop-out voltage regulator.

Figure 8:
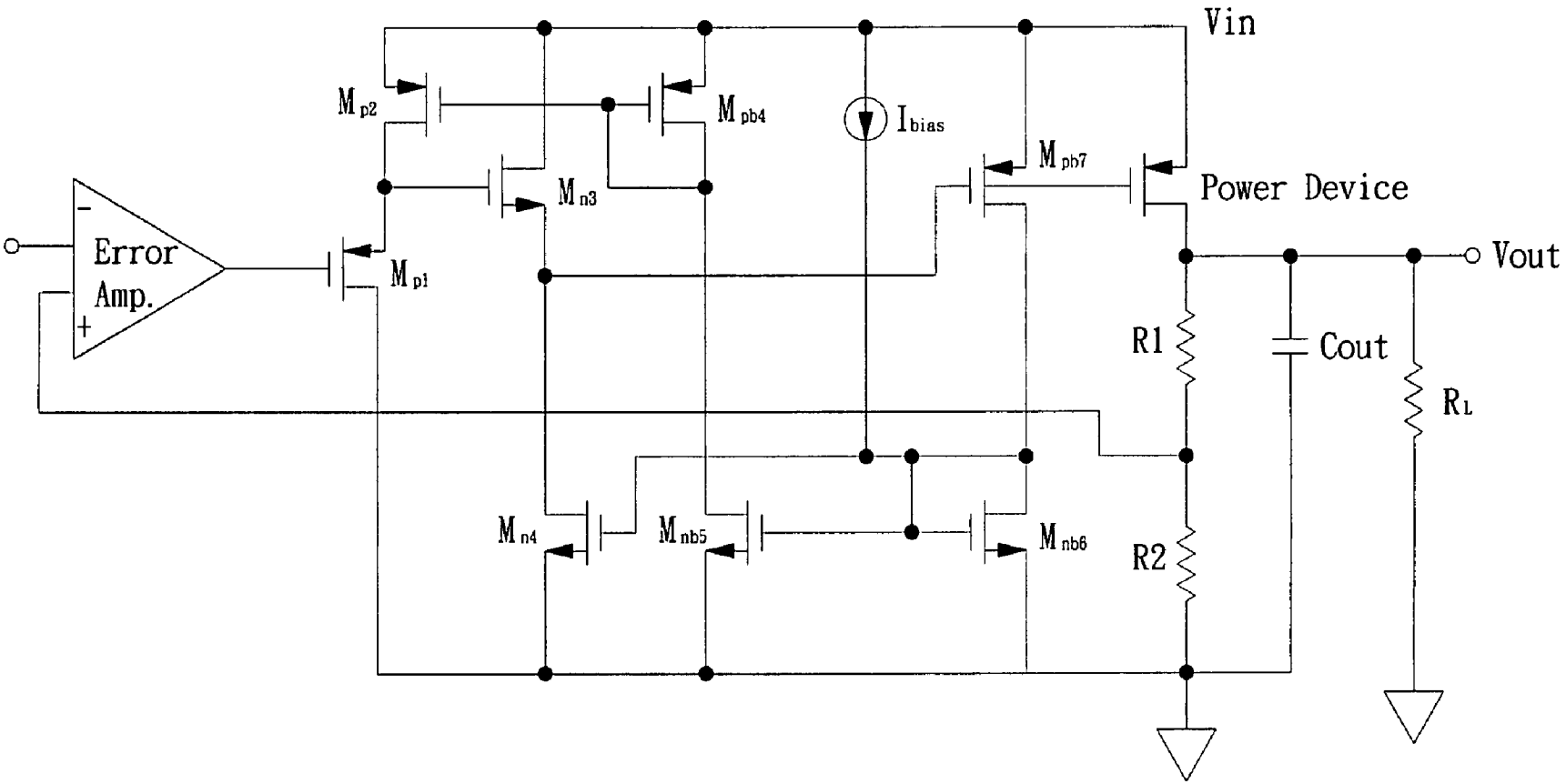
FIG. 8 is a detailed circuit diagram of a low drop-out voltage regulator wherein the bias current for the frequency compensation circuit in the complementary type buffer is replaced by a dynamic current.

Please refer to FIG. 8, which is a detailed circuit diagram of a low drop-out voltage regulator wherein the bias current for the frequency compensation circuit in the complementary type buffer is replaced by a dynamic current. Compared to FIG. 5, the low drop-out voltage regulator in FIG. 8 provides similar functions as the low drop-out voltage regulator in FIG. 5. Therefore, the circuit in FIG. 8 is within the scope of the present invention. In FIG. 8, the power device and another power device $M_{pb7}$ form a current mirror, which is capable of mirroring 1/n the current from the power device to another power device $M_{pb7}$. $M_{Nb6}$ and $M_4$ also form a current mirror, which is capable of providing a current to the n-type buffer. $M_{nb6}$ and $M_{nb5}$ form a current mirror and $M_{Pb4}$ and $M_{P2}$ also form a current mirror. These two current mirrors provide currents to the p-type buffer.

From FIG. 4A to FIG. 8, it is understood that the present invention discloses a low drop-out voltage regulator with high-performance linear and load regulation a low drop-out voltage regulator with high-performance linear and load regulation using a complementary type buffer for frequency compensation to overcome poor linear and load regulation and poor stability in a conventional voltage regulator using an n-type buffer or a p-type buffer.

Moreover, in the embodiment of the present invention, in the complementary type buffer, the voltage signal first goes through the p-type buffer and then the n-type buffer. However, it is feasible that the voltage signal first goes through the n-type buffer and then the p-type buffer. Meanwhile, the error amplifier of the present invention is not restricted to the embodiment and can be implemented using any differential amplifier with two inputs and one output.

Accordingly, the present invention discloses a low drop-out voltage regulator with high-performance linear and load regulation a low drop-out voltage regulator with high-performance linear and load regulation using a complementary type buffer for frequency compensation to overcome poor linear and load regulation and poor stability in a conventional voltage regulator using an n-type buffer or a p-type buffer. Therefore, the present invention is novel, useful and non-obvious.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A low drop-out voltage regulator with high-performance linear and load regulation, comprising:

a reference voltage circuit, capable of providing a reference voltage;

a differential amplifier;

a power device, capable of driving a load resistor;

a feedback circuit, disposed between the differential amplifier and the power device so that the differential amplifier outputs a correction voltage after the reference voltage and a feedback voltage across the feedback circuit; and a voltage buffer for frequency compensation, disposed between the differential amplifier and the power device, the voltage buffer comprising a complementary type buffer, wherein the complementary type buffer comprises a p-type buffer and an n-type buffer and each the p-type buffer and the n-type buffer is driven by a bias current provided by at least two current mirrors respectively.

2. The low drop-out voltage regulator with high-performance linear and load regulation as recited in claim 1, wherein the differential amplifier is an error amplifier.

3. The low drop-out voltage regulator with high-performance linear and load regulation as recited in claim 1, wherein one of each of at least two current mirrors is capable of mirroring 1/n the current from the power device to another power device.

4. A low drop-out voltage regulator with high-performance linear and load regulation, comprising:

a reference voltage circuit, capable of providing a reference voltage;

a differential amplifier;

a power device, capable of driving a load resistor;

a feedback circuit, disposed between the differential amplifier and the power device so that the differential amplifier outputs a correction voltage after the reference voltage and a feedback voltage across the feedback circuit; and a voltage buffer for frequency compensation, disposed between the differential amplifier and the power device, the voltage buffer comprising a complementary type buffer, wherein the complementary type buffer comprises a p-type buffer and an n-type buffer and each the p-type buffer and the n-type buffer is driven by a bias current provided by a current source respectively.

5. The low drop-out voltage regulator with high-performance linear and load regulation as recited in claim 4, wherein the differential amplifier is an error amplifier.

* * * * *